US009208966B2

(12) United States Patent
Sugiyama et al.

(10) Patent No.: US 9,208,966 B2
(45) Date of Patent: Dec. 8, 2015

(54) SWITCH

(71) Applicant: KABUSHIKI KAISHA TOSHIBA, Minato-ku (JP)

(72) Inventors: Hiroyuki Sugiyama, Yokohama (JP); Yoshiaki Ohda, Yokohama (JP); Masayuki Ando, Kawasaki (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 14/466,067

(22) Filed: Aug. 22, 2014

(65) Prior Publication Data

US 2015/0084722 A1 Mar. 26, 2015

(30) Foreign Application Priority Data

Sep. 20, 2013 (JP) ..... 2013-195042

(51) Int. Cl.

| | |
|---|---|
| ***H01H 9/30*** | (2006.01) |
| ***H01H 33/14*** | (2006.01) |
| ***H01H 33/666*** | (2006.01) |
| ***H01H 1/64*** | (2006.01) |
| ***H01H 3/32*** | (2006.01) |

(Continued)

(52) U.S. Cl.

CPC . *H01H 9/30* (2013.01); *H01H 1/64* (2013.01); *H01H 3/32* (2013.01); *H01H 33/143* (2013.01); *H01H 33/6661* (2013.01); *H01H 3/28* (2013.01); *H01H 2033/028* (2013.01)

(58) Field of Classification Search

CPC ..... H01H 33/6661; H01H 2033/028
USPC ..... 218/3
See application file for complete search history.

(56) References Cited

U.S. PATENT DOCUMENTS

| | | | |
|---|---|---|---|
| 4,434,332 | A | 2/1984 | Yanabu et al. |
| 2001/0002664 | A1 | 6/2001 | Stechbarth et al. |

(Continued)

FOREIGN PATENT DOCUMENTS

| | | | |
|---|---|---|---|
| EP | 1 109 187 | A1 | 6/2001 |
| EP | 2 402 969 | A1 | 1/2012 |

(Continued)

OTHER PUBLICATIONS

Extended European Search Report issued Feb. 19, 2015 in Patent Application No. 14185031.3.

*Primary Examiner* — Ramon Barrera
(74) *Attorney, Agent, or Firm* — Oblon, McClelland, Maier & Neustadt, L.L.P.

(57) ABSTRACT

A switch includes: a second conductor; a second movable electrode provided in a second hermetic space so as to be movable in a first direction in which it parts from the fixed electrode and in a second direction opposite the first direction; an opposed electrode slidably provided in the fixed electrode to face the second movable electrode so as to open from and be in contact with the second movable electrode in an open state and a closed state respectively; a second driver which generates a driving force and moves the second movable electrode in the first direction when performing an opening operation; and a driving force transmitting mechanism which moves the opposed electrode in the second direction by converting a direction of the driving force for moving the second direction opposite the moving direction of the second movable electrode when the second driver generates the driving force for moving the second movable electrode in the first direction.

7 Claims, 5 Drawing Sheets

(51) Int. Cl.
*H01H 3/28* (2006.01)
*H01H 33/02* (2006.01)

(56) References Cited

U.S. PATENT DOCUMENTS

| | | | |
|---|---|---|---|
| 2007/0194872 | A1 | 8/2007 | Pfister et al. |
| 2014/0132373 | A1 | 5/2014 | Takahashi et al. |
| 2015/0083691 | A1 | 3/2015 | Matsui et al. |

FOREIGN PATENT DOCUMENTS

| | | | |
|---|---|---|---|
| EP | 2 851 918 | A1 | 3/2015 |
| JP | 2003-348721 | | 12/2003 |
| JP | 2015-33187 | A | 2/2015 |
| JP | 2015-43656 | A | 3/2015 |
| JP | 2015-56239 | A | 3/2015 |
| JP | 2015-56249 | A | 3/2015 |
| JP | 2015-60777 | A | 3/2015 |
| WO | WO 2007/064535 | A1 | 6/2007 |
| WO | WO 2013/042566 | A1 | 3/2013 |

SWITCH

CROSS REFERENCE TO RELATED APPLICATIONS

This application is based upon and claims the benefit of priority from the prior Japanese Patent Application No. 2013-195042, filed on Sep. 20, 2013; the entire contents of which are incorporated herein by reference.

FIELD

Embodiments described herein relate generally to a switch.

BACKGROUND

A switch for high voltage responsible for interrupting a fault current has to satisfy the following two items when interrupting the current.

One is to surely extinguish, in a very short time, an arc generated between contacts after the opening. The other is to prevent dielectric breakdown when a transient recovery voltage rapidly rises between the contacts after the arc extinction.

In recent years, there has been widely adopted a puffer switch of a type in which one circuit breaker part having connectable/separable contacts are housed in a pressure vessel in which SF6 gas as insulating gas is sealed, and the insulating gas is sprayed to the contacts at the time of an interrupting operation, to extinguish an arc. In this type, the aforesaid two items have to be achieved with a single circuit breaker.

On the other hand, there has also been developed a switch of a type that achieves the interruption of the fault current by connecting circuit breaker parts each specialized in satisfying one of the aforesaid two items. That is, this is a switch of a type having the plural circuit breaker parts and assigning the roles separately to the respective circuit breaker parts. Such a switch is formed by separating an inner space of a pressure vessel, housing the circuit breaker part excellent in arc extinction performance and the circuit breaker part excellent in insulation performance in the one and other parts of the space respectively, and electrically connecting the both in series.

In the switch in which the circuit breaker parts specialized in the aforesaid interrupting duties respectively are coupled, each of the circuit breaker parts has its own connectable/separable contacts, and an interrupting operation and a conducting operation of all the contacts are performed by a single operation part (actuator), so that a load to the operation part is great.

A cause of a great load to the operation part is not only an increase of the number of the contacts which perform the interrupting/conducting operations but also a loss due to structures for transmitting a driving force of the single operation part to the plural contacts. Since the operation part is provided on an outer side of a pressure vessel in which the contacts are disposed, the number of transmitting parts including a rotating lever and a link mechanism also increases in order to transmit the driving force to the contacts in the tank. Accordingly, a weight of the structures for transmitting the driving force of the operation part to the contacts also increases.

Therefore, a large driving force is necessary, and the kind and size of the operation part are limited. When operation energy cannot be made large, there is a disadvantage that the interruption time becomes long.

A gas switch according to this embodiment has an object to provide a switch which is capable of easily achieving interruption duties required for a high-voltage switch and whose interruption time is short.

DETAILED DESCRIPTION

According to one embodiment, a switch includes a hermetic vessel, an insulating spacer, a fixed electrode, a first conductor, a second conductor, a first movable electrode, a second movable electrode, an opposed electrode, a first driver, a second driver, and a driving force transmitting mechanism.

The hermetic vessel is filled with an insulating medium. The insulating spacer divides the hermetic vessel into a first hermetic space and a second hermetic space.

The fixed electrode penetrates through and is fixed to the insulating spacer. The first conductor is led into the first hermetic space.

The second conductor is led into the second hermetic space.

The first movable electrode is movably provided in a vacuum vessel disposed in the first hermetic space so as to abut on/separate from the fixed electrode, and is connected to the first conductor directly or via another member.

The second movable electrode is provided in the second hermetic space so as to be movable in a first direction to become apart from the fixed electrode and in a second direction opposite the first direction, and is connected to the second conductor directly or via another member.

The opposed electrode is slidably provided in the fixed electrode to face the second movable electrode so as to open (separate or detach) from the second movable electrode in an open state and so as to contact with the second movable electrode in a closed state.

When breaking a circuit between the first conductor and the second conductor, the first driver generates a driving force and moves the first movable electrode so as to open (separate or detach) the first movable electrode from the fixed electrode.

When performing an opening operation, the second driver generates a driving force and moves the second movable electrode in the first direction.

When the second driver generates the driving force to move the second movable electrode in the first direction, the driving force transmitting mechanism moves the opposed electrode in the second direction by converting a direction of the driving force for moving the second direction opposite the moving direction of the second movable electrode.

First Embodiment (Whole Structure)

Hereinafter, the structure of a switch of this embodiment will be described with reference to FIG. 1 to FIG. 3.

Figure 1:
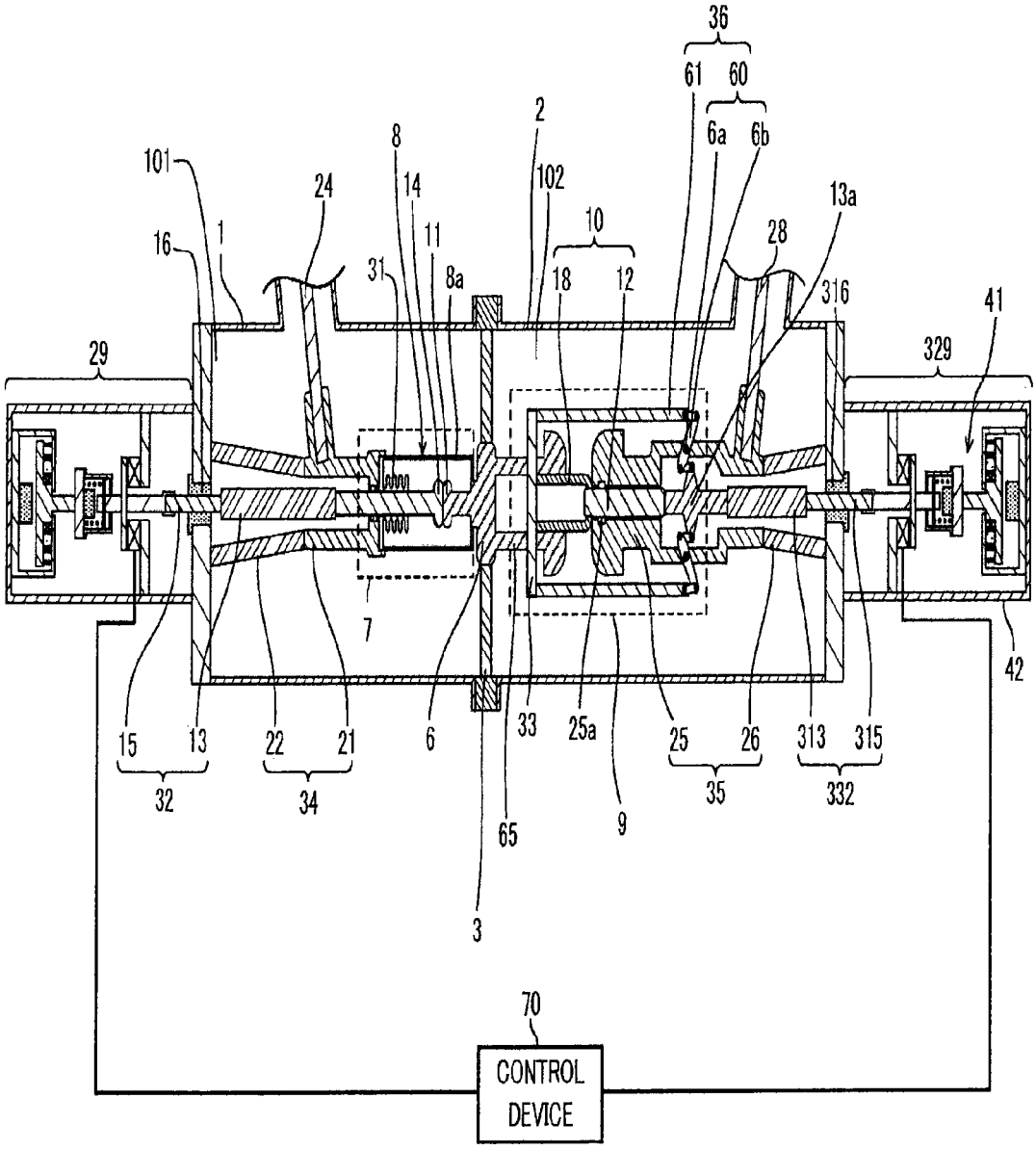
FIG. 1 is a cross-sectional view illustrating the whole structure of a switch according to a first embodiment, and illustrates a closed state.
Figure 2:
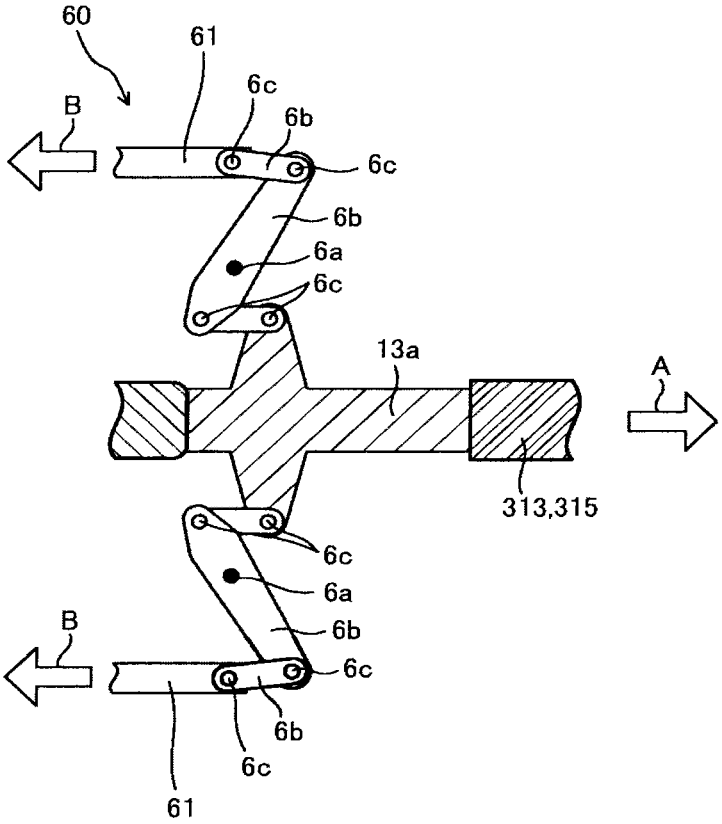
FIG. 2 is a view illustrating an example of a link mechanism of the switch in FIG. 1.

FIG. 1 and FIG. 2 are cross-sectional views illustrating the structure of a gas circuit breaker of this embodiment.

Figure 3:
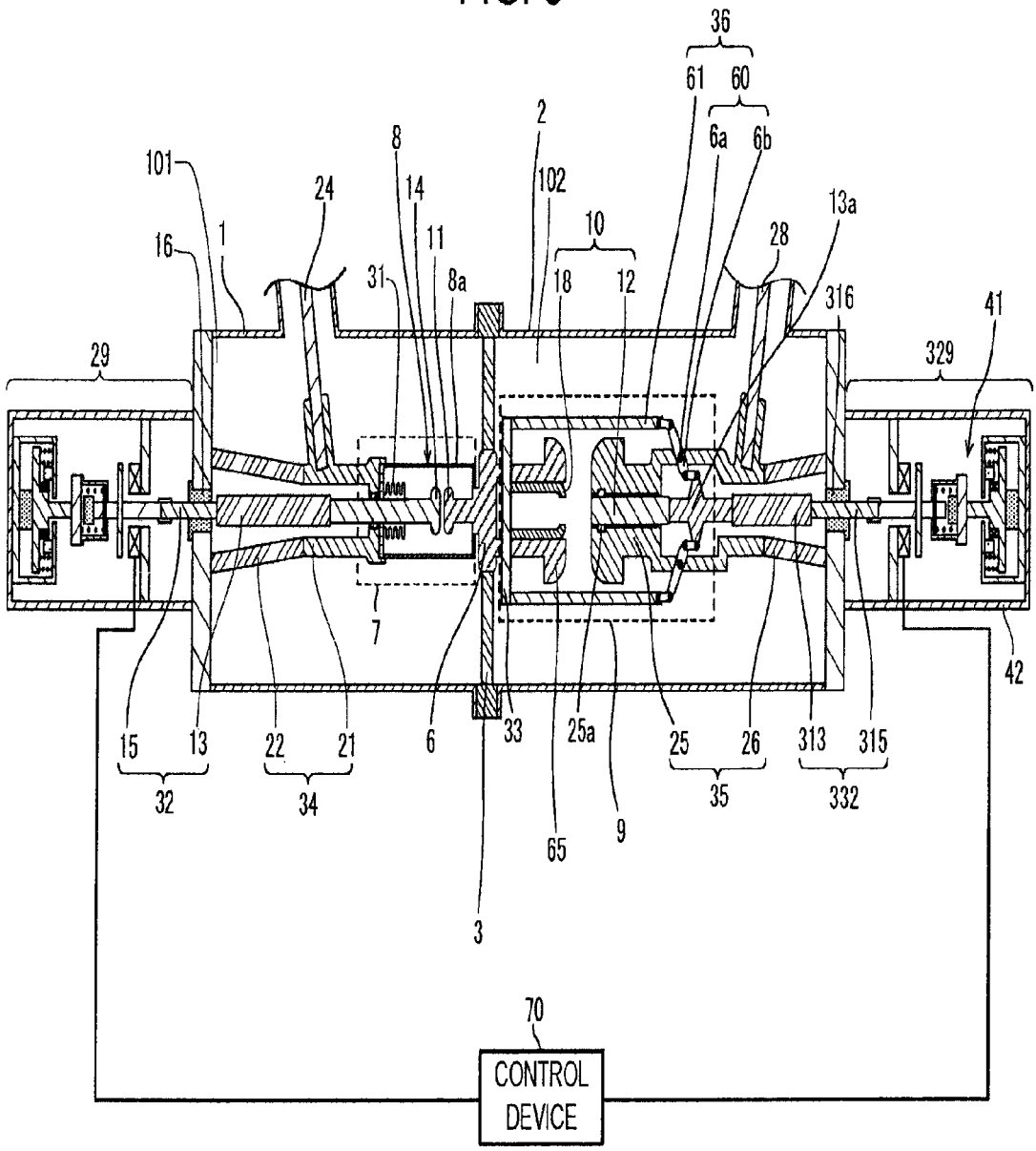
FIG. 3 is a view illustrating the switch of the first embodiment in an open state.

Note that FIG. 1 illustrates a state where the switch is in a current conduction state, and FIG. 3 illustrates a state where the switch is in a current interruption state.

The switch of this embodiment has a plurality of contacts electrically connected in series, and switches over between the current conduction state and the current interruption state by connecting/separating the contacts.

The switch of this embodiment includes: pressure vessels 1, 2 made of grounded metal, insulator, or the like; a plurality of (two here) contact parts 7, 9 having a pair of contacts that are connectable/separable; an insulating spacer 3 dividing the inside of the pressure vessels 1, 2 into the same number of (two here) spaces as the number of the contact parts; and a spacer electrode 6 penetrating through the insulating spacer 3 and fixed to the insulating spacer 3.

The pressure vessels 1, 2 are cylindrical vessels each having one surface bottomed and an opposed surface opened, and having a flange portion along an open end portion.

The pressure vessels 1, 2 form a hermetic vessel. The facing flange portions of the pressure vessels 1, 2 are fastened together across the insulating spacer 3.

The contact of the contact part 7 is housed in the pressure vessel 1.

The contact of the contact part 9 is housed in the pressure vessel 2 and is electrically connected in series to the spacer electrode 6 fixed to the insulating spacer 3.

Note that, in the following, for convenience' sake, the term "fixed electrode" is sometimes used as including the spacer electrode 6, and a fixed-side electrode 11 of a vacuum valve 8 and a support part 65, described below, which are connected to the spacer electrode 6.

A conductor 24 as the first conductor is led into to the pressure vessel 1 so as to extend toward the contact part 7.

The conductor 24 is electrically connected to the contact of the contact part 7.

A conductor 28 as the second conductor is led into the pressure vessel 2 so as to extend toward the contact part 9. The conductor 28 is electrically connected to the contact of the contact part 9.

When the switch is in the conduction state, a current is led from the conductor 24.

The current led from the conductor 24 is led out to the conductor 28 sequentially through the contact of the contact part 7, the spacer electrode 6, and the contact of the contact part 9.

Further, when the switch is in the interruption state, the contacts of the contact parts 7, 9 are opened, and accordingly the current is interrupted.

Hereinafter, the structure of the switch of this embodiment will be described in detail.

(Detailed Structure)

(Inner Spaces 101, 102)

An inner space 101 (first hermetic space) is formed by the pressure vessel 1, the insulating spacer 3, and so on, and an inner space 102 (second hermetic space) is formed by the pressure vessel 2, the insulating spacer 3, and so on.

The inner spaces 101, 102 are in a hermetic state, and in this embodiment are in a completely hermetic state. Such inner spaces 101, 102 are filled with an insulating medium.

As the insulating medium, sulfur hexafluoride gas (SF6 gas), carbon dioxide, nitrogen, dry air, or mixed gas of these, insulating oil, or the like may be used, for instance.

In this embodiment, SF6 gas is filled. Incidentally, pressures of the inner space 101 and the inner space 102 may be different or equal as required.

In this embodiment, the pressure of the gas in the inner space 101 is not higher than the pressure of the gas in the inner space 101 nor lower than an atmospheric pressure.

(Contact Part 7)

The contact part 7 is a vacuum contact part in which electrodes are housed in a vacuum vessel with a high vacuum degree, and interrupts the current by utilizing excellent insulation strength and arc extinction property of the high vacuum.

Hereinafter, it is assumed that the contact part 7 is the vacuum contact part 7.

The vacuum contact part 7 includes: a vacuum valve 8 having the contact; an operation part 29 as the first driver which drives this contact; and a coupling part 32 which transmits a driving force of the operation part 29 to the contact.

One end of the vessel of the vacuum valve 8 is supported by the spacer electrode 6.

Further, the other end of the vessel of the vacuum valve 8 is fixed to a support part 34 attached to the pressure vessel 1.

Consequently, the vacuum valve 8 is fixed at a predetermined position in the pressure vessel 1.

The vacuum valve 8 has a cylindrical vacuum vessel 8*a* whose inner part has a high vacuum degree, and the vacuum vessel 8*a* is housed in the pressure vessel 1.

This vacuum vessel 8*a* is an insulating cylinder made of, for example, glass, ceramic, or the like.

In the vacuum vessel 8*a*, a pair of electrodes (the fixed-side electrode 11 and a movable electrode 14) forming the contact, and a bellows 31 are housed.

In the vacuum valve 8, the fixed-side electrode 11 and the movable electrode 14 are disposed to face each other.

The fixed-side electrode 11 is fixed and connected to the spacer electrode 6 fixed to the insulating spacer 3.

The fixed-side electrode 11 and the movable electrode 14 are mechanically connectable/separable.

When the switch enters the interruption state from the conduction state, the movable electrode 14 separates from the fixed-side electrode 11, and an arc is generated between the both electrodes 11, 14.

The movable electrode 14 has one end facing the fixed-side electrode 11 and the other end penetrating through a wall surface of the vacuum vessel 8*a* and extending out of the wall surface.

The movable electrode 14 is movably provided so as to abut on/separate from the fixed-side electrode 11, and is connected to the conductor 24 directly or via a conductive support portion 21 (another member).

The bellows 31 is provided on an inner wall surface of the vacuum vessel 8*a* at a place where the movable electrode 14 penetrates through the wall surface of the vacuum vessel 8*a*.

The bellows 31 is expandable/contractible, and keeps the inside of the vacuum vessel 8*a* airtight even when the movable electrode 14 is connected/separated to/from the fixed-side electrode 11.

The operation part 29 is disposed outside the pressure vessel 1, and by moving the movable electrode 14, it is capable of connecting/separating the movable electrode 14 to/from the fixed-side electrode 11.

The operation part 29 is controlled to be driven by a command signal from a control device 70 installed outside the switch, to generate the driving force.

The operation part 29 pushes/pulls the movable electrode 14 on one straight line by the generated driving force, so that the movable electrode 14 is connected/separated to/from the fixed-side electrode 11.

When breaking a circuit between the first conductor 24 and the second conductor 28, the operation part 29 generates a driving force in such a direction as to pull an operation rod 15 (left direction in FIG. 1), to move the movable electrode 14 so that the movable electrode 14 separates from the fixed-side electrode 11.

The coupling part 32 is provided between the operation part 29 and the movable electrode 14. The coupling part 32 is composed of a rod-shaped insulating rod 13 made of an insulating member and the rod-shaped operation rod 15 made of a conductive member.

The insulating rod 13 and the operation rod 15 are disposed coaxially with the fixed-side electrode 11 and the movable electrode 14.

The insulating rod 13 has one end connected to the movable electrode 14 and the other end connected to the operation rod 15.

The operation rod 15 penetrates through a wall surface of the pressure vessel 1 from the insulating rod 13, extends to the outside of the pressure vessel 1, and is connected to the operation part 29.

On a portion of the wall surface of the pressure vessel 1 through which the operation rod 15 penetrates, a sealing part 16 having a not-illustrated elastic packing is provided.

The inner space 101 is kept airtight even when the operation rod 15 is in slide contact with the packing of the sealing part 16.

In this embodiment, the driving force of the operation part 29 is transmitted to the movable electrode 14.

(Contact Part 9)

As the contact part 9, a puffer-type gas contact part or a non-puffer-type gas contact part is usable.

The puffer-type gas contact part has electrodes forming a contact, a puffer cylinder which accumulates pressures for spraying the insulating gas to the arc, and a nozzle which guides the spraying of the insulating gas to the arc.

In an interrupting operation and a conducting operation, the operation part drives these members in linkage with the electrodes.

On the other hand, the non-puffer-type gas contact part does not have such a puffer cylinder or nozzle.

The contact part 9 of this embodiment is a gas contact part of the non-puffer type which is higher in dielectric strength than the vacuum contact part 7 and is capable of high-speed driving.

Hereinafter, it is assumed that the contact part 9 is the gas contact part 9.

The gas contact part 9 includes the contact 10, a driving force transmitting mechanism 36 which transmits a driving force, an electrode seat 33 which transmits the driving force of the driving force transmitting mechanism 36 to the contact (especially an opposed electrode 18), and the support part 65 fixed to the spacer electrode 6 to support the electrode seat 33 while allowing the electrode seat 33 to move.

The contact 10 of the gas contact part 9 is composed of a pair of electrodes (the movable electrode 12 as the second movable electrode and the opposed electrode 18) disposed to face each other in the pressure vessel 2.

This contact 10 is a contact in which an area of a contact portion and a separation distance at the time of the opening are both larger than those in the contact of the vacuum valve 8 of the vacuum contact part 7 and which is higher in dielectric strength than the contact that the vacuum valve 8 has.

The movable electrode 12 is movably supported by a support part 35 while sliding.

The movable electrode 12 is provided inside (in the second hermetic space of) the pressure vessel 2 so as to be movable in a first direction (right direction in FIG. 1) in which it becomes apart from the spacer electrode 6 and in a second direction opposite the first direction.

The movable electrode 12 is electrically connected to the conductor 28 via a conductive support portion 25 (another member).

In a case where the conductor 28 and the conductive support portion 25 are integrally structured, the movable electrode 12 is directly connected to the conductor 28.

The opposed electrode 18 is movably provided while facing the movable electrode 12 and sliding on an inner surface of the support part 65 with a substantially C-shape fixed to the spacer electrode 6, so as to separate from the movable electrode 12 in an open state and so as to come into contact with the movable electrode 12 in a closed state.

That is, the opposed electrode 18 is mechanically connectable/separable to/from the movable electrode 12.

The opposed electrode 18 is provided on the electrode seat 33 and the electrode seat 33 is coupled to insulating operation rods 61 via the driving force transmitting mechanism 36.

The insulating operation rods 61 and the electrode seat 33 are moved in linkage by a driving force of an operation part 329 as the second driver.

In linkage with an axial movement of the insulating operation rods 61 by the driving force of the operation part 329, the opposed electrode 18 and the movable electrode 12 are mechanically connected/separated.

The electrode seat 33 has a flat plate shape and has the opposed electrode 18 fixed to its center portion.

The electrode seat 33 is slidably supported by the support part 65. Both ends of the electrode seat 33 are connected to the insulating operation rods 61.

The driving force transmitting mechanism 36 is connected to a coupling rod 13*a* connected to an insulating rod 313.

The driving force transmitting mechanism 36 includes: a link mechanism 60 which converts a moving direction of a coupling part 332 to a reverse direction; and the insulating operation rods 61 connected to the link mechanism 60.

When the operation part 329 generates the driving force to move the movable electrode 12 in the first direction, the driving force transmitting mechanism 36 converts the direction of the driving force to the second direction opposite the movement direction of the movable electrode 12 to move the opposed electrode 18.

That is, the movable electrode 12 and the opposed electrode 18 move simultaneously in the opposite directions by the link mechanism 60.

The coupling rod 13*a* is a member having a substantially cross-shaped section.

One bar of the cross of the coupling rod 13*a* extends in a coaxial direction with the insulating rod 313 and the movable electrode 12 (in the drawing: left and right direction), and its one end is connected to the insulating rod 313 and its other end is connected to the movable electrode 12.

The other bar of the cross of the coupling rod 13*a* extends in a direction perpendicular to the axial direction of the insulating rod 313 and the movable electrode 12 (in the drawing; up and down direction), and its both ends are connected to the link mechanism 60.

As illustrated in FIG. 2, the link mechanism 60 includes a mechanism which transmits the driving force from the operation part 329 between the coupling rod 13*a* and the insulating operation rods 61 and also converts (reverses) the direction of the driving force relating to the coupling rod 13*a* to the opposite direction.

Concretely, the link mechanism 60 includes: a plurality of link members 6*b* which transmit the driving force by a joint structure; free ends 6*c* at which the link members 6*b* are pivotably connected by pins; and fixed points 6*a* each for making one member of the link members 6*b* pivot on a predetermined position being a fulcrum.

The link members 6*b* are composed of a plurality of rod-shaped members connected by the pins, for instance. One-side ends of the link members 6*b* are connected to the coupling rod 13*a* and the other ends are connected to the insulating operation rods 61.

The fixed points 6*a* serving as the fulcrums are supported by the conductive support portion 25 and serve as the fulcrums when the link members 6*b* move.

The link members 6*b* are provided to be pivotable on the fixed points 6*a*.

In this example, when the coupling rod 13*a* is pulled in an arrow A direction (first direction) in which the coupling rod 13*a* becomes apart from the spacer electrode 6, the insulating operation rods 61 move (are pushed out) in an arrow B direction (second direction) opposite the arrow A direction.

The insulating operation rods 61 are members which transmit the driving force transmitted from the link mechanism 60 to the electrode seat 33.

The insulating operation rods 61 are rod-shaped members and their one-side ends are connected to the link mechanism 60.

The insulating support portion 26 and the conductive support portion 25 are provided concentrically.

Between the conductive support portion 25 and the movable electrode 12, a conductive contactor 25*a* made of a conductive member is provided to electrically connect the both.

On the other hand, the opposed electrode 18 is made slidable on the support part 65 by the electrode seat 33.

Incidentally, a conductive contactor 25*a*, not illustrated, made of a conductive member is also provided between the electrode seat 33 and the support part 65 to electrically connect the both.

The operation part 329 is projectingly disposed on an outer side (sidewall) of the pressure vessel 2, and simultaneously moves the movable electrode 12 and the opposed electrode 18 to connect/separate the movable electrode 12 and the opposed electrode 18.

The operation part 329 is controlled to be driven by the command signal from the control device 70 installed outside the switch and generates the driving force.

By the generated driving force, the operation part 329 makes the movable electrode 12 and the opposed electrode 18 approach each other or part from each other on one straight line, so that the movable electrode 12 and the opposed electrode 18 are connected/separated at a high speed.

When breaking the circuit between the conductor 24 and the conductor 28, the operation part 329 generates a driving force in such a direction as to pull an operation rod 315 (arrow A direction illustrated in FIG. 2) and moves so as to detach the moving electrode 12 and the opposed electrode 18.

At the same time, the driving force of the operation part 329 is converted to a driving force in such a direction as to push the electrode seat 33 via the driving force transmitting mechanism 36 (arrow B direction illustrated in FIG. 2), and the operation part 329 moves so as to detach the opposed electrode 18 from the movable electrode 12.

Between the operation part 329 and the movable electrode 12, the support part 35 and the coupling part 332 are provided.

The coupling part 332 is composed of the rod-shaped insulating rod 313 made of an insulating member and the rod-shaped operation rod 315 made of a conductive member.

The insulating rod 313 and the operation rod 315 are disposed coaxially with the opposed electrode 18 and the movable electrode 12.

One end of the insulating rod 313 is connected to the movable electrode 12 via the coupling rod 13*a* of the driving force transmitting mechanism 36 and its other end is connected to the operation rod 315.

The operation rod 315 penetrates from the insulating rod 313 through a wall surface of the pressure vessel 2, extends to the outside of the pressure vessel 2, and is connected to the operation part 329.

On a portion of the wall surface of the pressure vessel 2 through which the operation rod 315 penetrates, a sealing part 316 having a not-illustrated elastic packing is provided.

The inner space 102 is kept airtight even when the operation rod 315 is in slide contact with the packing of the sealing part 316.

In this embodiment, the driving force of the operation part 329 is transmitted to both the movable electrode 12 and the opposed electrode 18.

(Conduction State)

Next, the operation of the switch of the first embodiment will be described.

The state of the switch illustrated in FIG. 1 and FIG. 2 is the conduction state where the current is allowed to pass through the switch.

In this conduction state, the current is made to flow from the conductor 24 on the pressure vessel 1 side.

This current is led out through the conductor 24 sequentially to the conductive support part 21, the movable electrode 14, the fixed-side electrode 11, the spacer electrode 6, the support part 65, the opposed electrode 18, the movable electrode 12, the conductive contactor 25*a*, the conductive support portion 25, and the conductor 28.

(Interrupting Operation)

When performing the interrupting operation, the control device 70 outputs the command signals for the execution of the current interruption to the operation part 29 and the operation part 329 respectively.

When the command signal for the current interruption is given from the control device 70 to the operation part 29, the operation part 29 generates the driving force in such a direction as to open the contact of the vacuum valve 8, and by this driving force, the movable electrode 14 separates from the fixed-side electrode 11, so that the current interruption is started.

Further, when the command signal for the current interruption is given from the control device 70 to the operation part 329, the driving force is transmitted from the operation part 329 to the opposed electrode 18 and the movable electrode 12 via the driving force transmitting mechanism 36, so that the both electrodes operate to detach from each other.

Consequently, the current interruption is performed in the vacuum contact part 7 and the gas contact part 9. FIG. 3 illustrates a state where the vacuum contact part 7 and the gas contact part 9 are both in the open state.

(1) Regarding Movement of Movable Electrode 14

The operation part 29 gives the operation rod 15 the driving force in such a direction as to detach the movable electrode 14 from the fixed-side electrode 11 (left direction in the drawing) based on the command signal for the current interruption.

The operation rod 15 moves in such a direction as to open from the fixed-side electrode 11 (in the left direction in the drawing) by the driving force of the operation part 29.

Since the movable electrode 14 operates in linkage with the operation rod 15, the movable electrode 14 of the vacuum valve 8 separates from the fixed-side electrode 11.

In the course of the above, between the fixed-side electrode 11 and the movable electrode 14, the arc made of metal particles and electrons evaporated mainly from the electrodes is generated, but since the inside of the vacuum vessel 8*a* has a high vacuum degree, the substances forming the arc diffuse and cannot retain their shape to extinguish.

Consequently, the flowing current is interrupted.

Incidentally, the vacuum valve 8 includes the bellow 31 poor in high-pressure resistance, and the pressure of the gas in the inner space 101 is set to the pressure not higher than the gas pressure in the inner space 102 nor less than the atmospheric pressure, which is a pressure bearable by the bellows 31.

Consequently, the bellows 31 in the inner space 101 is protected while dielectric strength at the contact of the inner space 102 is ensured.

(2) Regarding Movement of Opposed Electrode 18

The operation part 329 gives the driving force in such a direction as to open the opposed electrode 18 from the movable electrode 12 (left direction in the drawing), via the driving force transmitting mechanism 36 which operates in linkage with the operation rod 315, according to the command signal for the current interruption from the control device 70.

The operation part 329 transmits the driving force in such a direction as to pull the coupling rod 13*a* (right direction in the drawing), to the driving force transmitting mechanism 36 via the coupling part 332 and the support part 35.

The driving force transmitting mechanism 36 converts the direction of this driving force (this will be referred to as the first direction) (refer to the arrow A in FIG. 2) to the opposite direction (this will be referred to as the second direction) (refer to the arrow B in FIG. 2) by the link mechanism 60 and transmits the converted driving force to the electrode seat 33 via the insulating operation rods 61.

Consequently, the opposed electrode 18 fixed to the electrode seat 33 moves in such a direction as to separate from the movable electrode 12, that is, in an opening direction (left direction in the drawing).

The opposed electrode 18 and the movable electrode 12 move in the reverse directions (opposite directions) to open at a high speed, so that the contact can be opened in a short time.

In this interruption process, separated gas is generated from the SF6 gas by the arc in the inner space 102.

This separated gas has an action to corrode a surface layer of the vacuum vessel 8*a* provided in the vacuum valve 8 and made of the insulator, but since the vacuum vessel 8*a* is housed in the hermetically sealed inner vessel 101, there is no concern about the corrosion of the vacuum vessel 8*a* by the separated gas generated in the inner space 102.

(Effects)

As described above, according to the first embodiment, the vacuum contact part 7 takes on the interruption of a steep transient recovery voltage in a SLF interruption duty, and the gas contact part 9 having high dielectric strength takes on the interruption of a high transient recovery voltage in a BTF interruption duty, which makes it possible to easily achieve the both interruption duties.

Note that the following effects are also obtained in this embodiment.

(1) Since this embodiment has the contact parts of different kinds, it is possible to perform the current interruption and ensure an insulation distance in a shorter time as compared with a switch having a single contact part.

(2) In this embodiment, the driving force transmitting mechanism 36 which transmits the driving force of the operation part 329 to the opposed electrode 18 is disposed inside the pressure vessel 2.

Therefore, as compared with a case where the driving force transmitting mechanism 36 is disposed outside the vessel, it is possible to simplify the structure of the driving force transmitting mechanism 36.

Therefore, it is possible to reduce a loss of the driving force caused by the complication of the structure of the driving force transmitting mechanism 36.

Consequently, as compared with a case where the driving force of the operation part 329 is transmitted to the opposed electrode 18 by the driving force transmitting mechanism 36 disposed outside the pressure vessel 2, it is possible to reduce the weight of the driving force transmitting mechanism 36.

Therefore, even when the driving force of the operation part 329 is small, it is possible to perform the current interruption and ensure the insulation distance in a shorter time.

(3) The contact part 7 further has the coupling part 32 which transmits the driving force of the operation part 29 to the contact, and the operation part 29 is disposed outside the pressure vessels 1, 2.

Consequently, the operation part 29 does not come into direct contact with the separated gas generated from the SF6 gas by the arc in the process of the interruption, and it is possible to prevent the separated gas from corroding the operation part 29.

(4) Out of the plural contact parts, at least one contact part is formed as the vacuum contact part 7 having the vacuum valve 8 including the contact, and at least one contact part is formed as the gas contact part 9 having the contact 10 larger in dielectric strength than the contact of the vacuum valve 8. Therefore, in the course of the interruption, the vacuum contact part 7 takes on the interruption of the steep transient recovery voltage in the SLF interruption duty, and the gas contact part 9 high in dielectric strength takes on the interruption of the high transient recovery voltage in the BTF interruption duty, which makes it possible to easily achieve the both interruption duties.

By thus providing at least one vacuum contact part 7 and at least one gas contact part 9, it is possible to achieve the SLF interruption duty and the BTF interruption duty separately by the respective contact parts.

(5) Further, since the vacuum valve 8 of the vacuum contact part 7 is a contact-type contact, the weight of the movable electrode 14 can be reduced.

Consequently, the interrupting operation in a very short time is possible. Since the gas contact part 9 of this embodiment does not have a puffer cylinder or a nozzle in the opposed electrode 18, a weight of movable parts driven by the operation part 329 is reduced as compared with a puffer-type circuit breaker.

Consequently, the operation part 329 can drive the opposed electrode 18 at a higher speed, which can greatly reduce the movement time required for ensuring the insulation distance.

As described above, the switch of this embodiment can perform the current interruption and ensure the insulation distance in a shorter time as compared with a conventional switch having a plurality of puffer-type circuit breakers, which can reduce the interruption time.

(6) Since the switch of this embodiment has the structure in which the inner space 101 and the inner space 102 are hermetically sealed, their pressures can be independently set to different pressures.

Concretely, the pressure of the gas in the inner space 101 is set not higher than the gas pressure in the inner space 102 nor lower than the atmospheric pressure.

Consequently, it is possible to protect the bellows 31 in the inner space 101 while ensuring the dielectric strength at the contact of the inner space 102.

Second Embodiment (Structure)

A second embodiment will be described with reference to FIG. 4 and FIG. 5.

Figure 4:
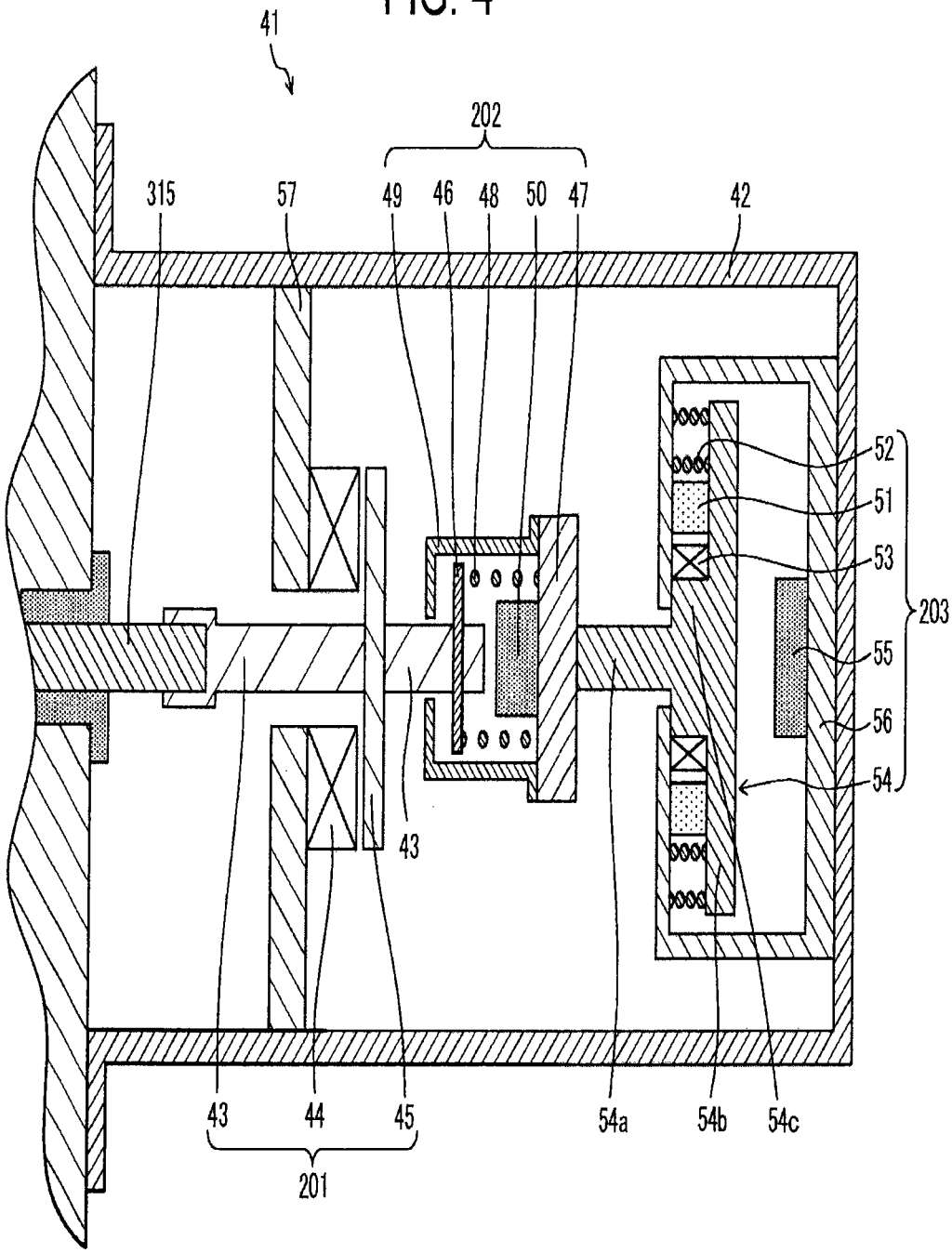
FIG. 4 is a view illustrating a structure of an electromagnetic repulsion operation part of a switch of a second embodiment, and illustrates a state of a position at the time of a closing operation.
Figure 5:
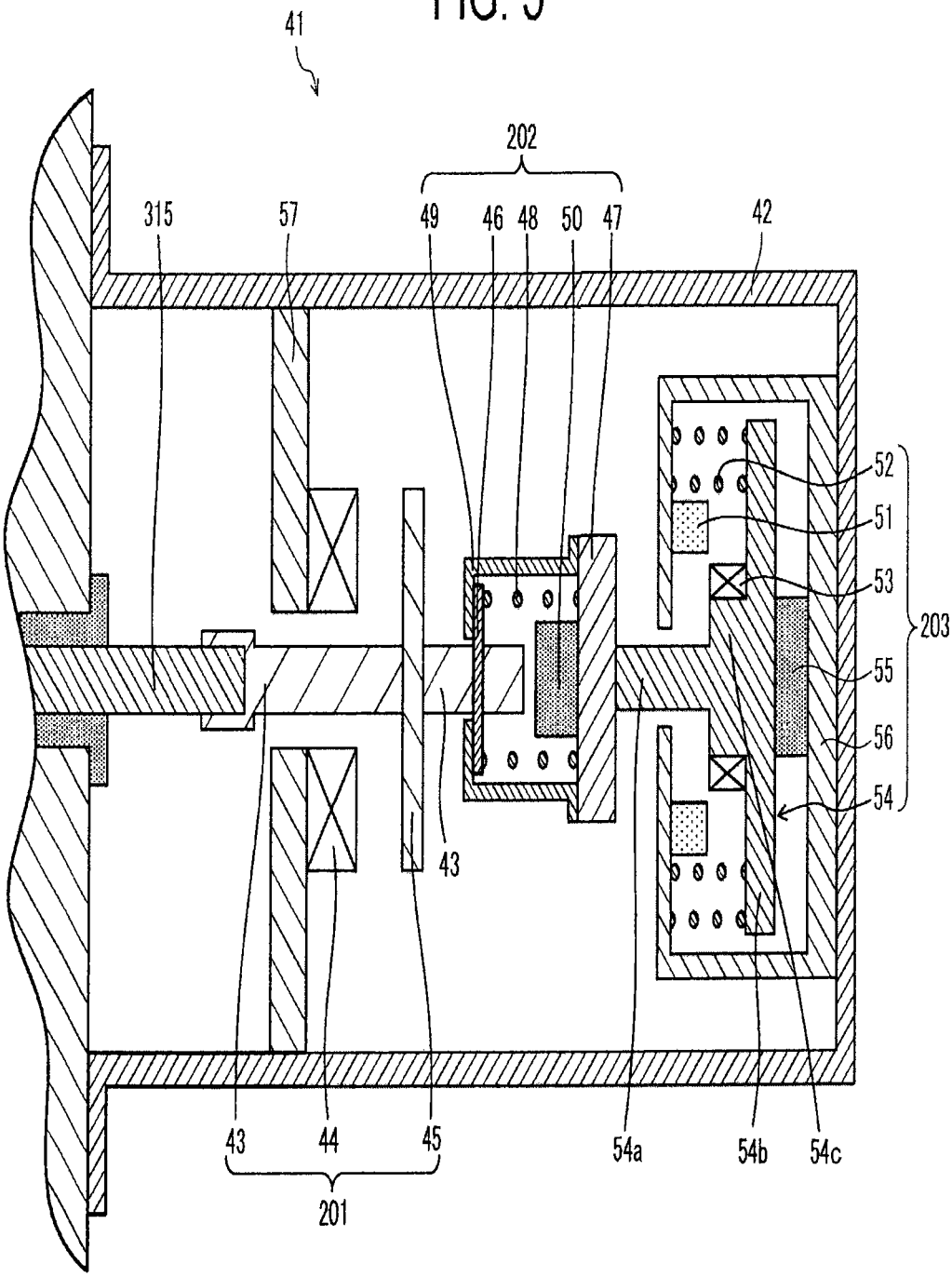
FIG. 5 is a view illustrating a state of a position at which a movable part stops when the electromagnetic repulsion operation part in FIG. 4 performs an opening operation.

FIG. 4 and FIG. 5 are cross-sectional views of an electromagnetic repulsion operation part 41 as an example of an inner structure of an operation part 329 according to the second embodiment.

FIG. 4 illustrates a state of the electromagnetic repulsion operation part 41 when it closes a contact part (current conduction state).

FIG. 5 illustrates a state of the electromagnetic repulsion operation part 41 when it opens the contact part (state where a current is interrupted).

A basic structure of the second embodiment is the same as that of the first embodiment.

Only what are different from the first embodiment will be described, and the same parts as those of the first embodiment will be denoted by the same reference signs, and detailed description thereof will be omitted.

Here, the electromagnetic repulsion operation part 41 as an example of the inner structure of the operation part 329 will be described. It is assumed that the inside of an operation part 29 which drives a vacuum contact part 7 also has the same structure.

As illustrated in FIG. 4, a switch according to the second embodiment uses the electromagnetic repulsion operation part 41 as the operation part of the vacuum contact part 7 or a gas contact part 9, or as the operation parts of the both.

This electromagnetic repulsion operation part 41 is a contact driving mechanism utilizing an electromagnetic repulsive force and has high responsiveness in an opening operation of the contact.

The electromagnetic repulsion operation part 41 has a mechanism box 42, a high-speed opening part 201, a wiping mechanism part 202, and a holding mechanism part 203.

The mechanism box 42 is a box having a hollow inner part, with its one end surface opened and with an opening edge of the end surface fixedly connected to a wall surface of a pressure vessel 1 on which a sealing part 316 is provided.

Members of the high-speed opening part 201, the wiping mechanism part 202, and the holding mechanism part 203 are housed in this mechanism box 42.

The high-speed opening part 201 includes a support part 57, a first movable shaft 43, an electromagnetic repulsion coil 44, and a repulsion ring 45.

The repulsion ring 45 is disposed on the electromagnetic repulsion coil 44 opposite a pressure vessel 2, to face the electromagnetic repulsion coil 44.

The repulsion ring 45 is an annular body made of a magnetic material, and in its annular hole, the first movable shaft 43 is fit, and the repulsion ring 45 is fixed to a periphery of the first movable shaft 43.

The first movable shaft 43 is a rod-shaped body connected to an operation rod 315.

The first movable shaft 43 is fixed to the repulsion ring 45 so as to penetrate through center portions of the support part 57 and the electromagnetic repulsion coil 44.

The ring-shaped support part 57 is fixed to an inner wall of the mechanism box 42, and the support part 57 supports the first movable shaft 43 so that the first movable shaft 43 is movable.

The support part 57 is a coil fixing part fixing the electromagnetic repulsion coil 44 to the pressure vessel 2 directly or via another member (mechanism box 42).

The electromagnetic repulsion coil 44 is a multi-wound coil and is provided on the support part 57 so as to face the repulsion ring 45.

A control device 70 is connected to the electromagnetic repulsion coil 44, and the control device 70 supplies an exciting current to the electromagnetic repulsion coil 44 from, for example, a condenser provided therein.

The electromagnetic repulsion coil 44 is excited by this exciting current to give an electromagnetic repulsive force to the repulsion ring 45, so that the first movable shaft 43 is driven.

Specifically, the control device 70 transmits a thrust of the first movable shaft 43 which is generated by exciting the electromagnetic repulsion coil 44, as a driving force to a driving force transmitting mechanism 36, and moves a second movable electrode 12 and an opposed electrode 18 by the driving force transmitting mechanism 36 in such a direction as to open these electrodes from each other, thereby opening a contact 10 at a high-speed.

The wiping mechanism part 202 transmits the electromagnetic repulsive force of the high-speed opening part 201 to the holding mechanism part 203.

This wiping mechanism part 202 includes: a collar 46 fit to the first movable shaft 43; a coupling 47 made of an insulating material; wiping springs 48 disposed between the collar 46 and the coupling 47; a collar presser 49 which presses the collar 46; and a shock absorber 50 as a first shock absorber which alleviates (or absorbs) a shock when the first movable shaft 43 collides therewith.

The coupling 47 is a flat plate, for instance, and is disposed to face the collar 46.

The wiping springs 48 each have one end connected to the collar 46 and the other end connected to the coupling 47 in a state where a biasing force is applied to the collar 46 and the coupling 47.

The collar presser 49 is a cylindrical bottomed body.

The collar presser 49 is fixed to the coupling 47 so as to surround the collar 46 and the wiping springs 48, and its bottom surface plays a role of a stopper of the collar 46.

Incidentally, an opening is provided in the bottom surface of the collar presser 49, and the first movable shaft 43 is movable through this opening.

The shock absorber 50 is fixed to the coupling 47 and alleviates a shock of the collision of the first movable shaft 43.

That is, the shock absorber 50 alleviates a force generated when the moving first movable shaft 43 collides with a second movable shaft 54*a* directly or via the coupling 47 being another member.

The holding mechanism part 203 is composed of a permanent magnet 51, opening springs 52, a solenoid coil 53, a movable part 54, a shock absorber 55 as a second shock absorber, and a holding mechanism box 56.

The holding mechanism box 56 is fixed to an inner surface of the mechanism box 42, and in its inside, the permanent magnet 51, the opening springs 52, the solenoid coil 53, the movable part 54, and the shock absorber 55 as the second shock absorber are housed.

The movable part 54 is a magnetic member on which an attraction force of the permanent magnet 51 works. The movable part 54 has a substantially T-shaped cross section and is composed of a portion being the second movable shaft 54*a* and a portion being a spring presser 54*b*.

The second movable shaft 54*a* extends from an opening of the holding mechanism box 56 toward the first movable shaft 43 and is fixed to the coupling 47.

The second movable shaft 54*a* is held in the mechanism box 42 so as to be coaxial with the first movable shaft 43 and movable in an axial direction independently of the first movable shaft 43.

The permanent magnet 51 is fixed to a first movable shaft 43-side inner surface of the holding mechanism box 56 so as to face the spring presser 54*b* of the movable part 54.

The permanent magnet 51 attracts the movable part 54 to maintain a state where the spring presser 54*b* abuts on the permanent magnet 51 (first position) (position illustrated in FIG. 4).

With such a structure, the holding mechanism part 203 normally holds the movable part 54 including the second movable shaft 54*a* at the first position (position illustrated in FIG. 4) at which the second movable shaft 54*a* is a predetermined interval apart from the first movable shaft 43.

The permanent magnet 51 and the movable part 54 generate a thrust in such a direction as to bring a movable electrode 14 included in a contact of a vacuum valve 8 or an opposed electrode 18 included in a contact of the gas contact part 9 into a closed and contact state.

Note that, in the description, it is assumed that the operation part 29 and the operation part 329 are the same mechanisms.

The opening springs 52 are provided between the spring presser 54*b* of the movable part 54 and the wall surface of the holding mechanism box 56 on which the permanent magnet 51 is provided, so as to give a biasing force to the movable part 54.

As each of the opening springs 52, used is one which, in the open state, has a larger biasing force than the sum of a self-closing force of the vacuum valve 8 and the attraction force of the permanent magnet 51 and in the closed state, has a smaller biasing force than the attraction force of the permanent magnet 51 working on the movable part 54.

The solenoid coil 53 is a winding made of a conductive member, and is wound around a root of a leg 54*c* of the movable part 54 to be fixed.

The control device 70 is connected to the solenoid coil 53, and the control device 70 supplies the exciting current to the solenoid coil 53 to excite the solenoid coil 53.

The shock absorber 55 is fixed to an inner wall surface of the holding mechanism box 56 facing the opening of the holding mechanism box 56, and the second movable shaft 54*a* which has collided with the shock absorber 55 is held at this second position (position illustrated in FIG. 5).

Specifically, at the normal time, the holding mechanism part 203 holds the second movable shaft 54*a* at the first position (FIG. 4) at which the second movable shaft 54*a* is the predetermined interval apart from the first movable shaft 43, and when the thrust in the direction toward the second movable shaft 54*a* is given to the first movable shaft 43, the holding mechanism part 203 holds the second movable shaft 54*a* at the second position (FIG. 5) to which the second movable shaft 54*a* moves when the both movable shafts are in contact with each other.

(Interrupting Operation)

The opening operations of the operation parts 29, 329 (electromagnetic repulsion operation parts 41) in the process of the interrupting operation of the switch of this embodiment will be described.

First, in the closed state illustrated in FIG. 4 where the fixed-side electrode 11 and the movable electrode 14 in the vacuum contact part 7, and the movable electrode 12 and the opposed electrode 18 of the contact part 9 are in contact with each other, when an interruption command is input to the control device 70 from an upper-order control system, the control device 70 supplies the current to the electromagnetic repulsion coils 44 of the operation parts 29, 329 to excite the electromagnetic repulsion coils 44.

Consequently, in the operation part 29, an electromagnetic repulsive force is generated in the repulsion ring 45, so that the movable electrode 14 performs the opening operation at a high speed in a separating direction (hereinafter, referred to as an opening direction in the vacuum contact part 7. Further, the opposite direction will be referred to as a closing direction) via the first movable shaft 43 and the coupling part 32.

Further, at the same time, in the operation part 329, the opposed electrode 18 and the movable electrode 12 perform the opening operation at a high speed in the direction so as to open from each other, via the coupling part 322 and the driving force transmitting mechanism 36.

In the electromagnetic repulsion operation part 41, as a result of the movement of the repulsion ring 45, the first movable shaft 43 moves in the opening operation, so that the collar 46 compresses the wiping springs 48 and collides with the shock absorber 50.

At this time, the first movable shaft 43 pushes the coupling 47 in the opening direction via the wiping springs 48 and the shock absorber 50, with its restitution in the closing direction being reduced by the shock absorber 50.

On the other hand, the solenoid coil 53 of the holding mechanism part 203 is supplied with the current from an external power source prior to a timing at which the first movable shaft 43 pushes the coupling 47 in the opening direction.

Consequently, the solenoid coil 53 is excited in such a direction as to cancel a magnetic flux of the permanent magnet 51, so that the attraction force of the permanent magnet 51 working on the movable part 54 reduces and the movable part 54 is driven in the opening direction by the biasing force of the opening springs 52.

Then, the collar presser 49 abuts on the collar 46 via the coupling 47, so that the movable part 54 pulls the coupling 47, the collar presser 49, and the collar 46 as a unit and further separates the movable electrode 12 and the opposed electrode 18 via the first movable shaft 43.

Thereafter, by an inertia force of the first movable shaft 43 and the biasing force of the opening springs 52, the movable electrode 12 is opened until there is provided a predetermined gap, and the movable part 54 collides with the shock absorber 55.

A shock of the collision is absorbed by the shock absorber 55 and the movable part 54 stops.

A state of a position at which the movable part 54 stops is illustrated in FIG. 5.

Note that the predetermined gap is an interval (distance) between a contact of the opposed electrode 18 and a contact of the movable electrode 12, necessary for the current interruption.

After the interval between the movable electrode 12 and the opposed electrode 18 becomes the predetermined gap, the supply of the current to the electromagnetic repulsion coil 44 and the solenoid coil 53 is stopped to cancel the excitation of these.

Even after this cancellation, the contact 10 maintains the open state since the biasing force of the opening springs 52 is larger than the sum of the self-closing force of the contact 10 and the attraction force of the permanent magnet 51.

(Conduction State)

In the conduction state in FIG. 1, the fixed-side electrode 11 and the movable electrode 12 are in contact with each other with a predetermined load.

The attraction force of the permanent magnet 51 working on the movable part 54 becomes larger than the opening force by the wiping springs 48 and the opening springs 52.

Therefore, by the attraction force of the permanent magnet 51, the movable part 54 compresses the opening springs 52 by its spring presser 54*b*, abuts on the permanent magnet 51, and is fixed to the permanent magnet 51.

Meanwhile, by this attraction force, the movable electrode 12 abuts on the opposed electrode 18 via the first movable shaft 43 and is given the biasing force by the wiping springs 48.

Thus, the opposed electrode 18 and the movable electrode 12 are in contact with each other by the attraction force of the permanent magnet 51 working on the movable part 54 and the load by the wiping springs 48, so that the conduction state (closed state) is maintained.

(Effects)

The switch according to this embodiment exhibits the following operations and effects in addition to the same effects and operations as those of the first embodiment.

In this embodiment, the operation part is the electromagnetic repulsion operation part 41. In the vacuum contact part 7, since a stroke being a movement distance of the contact of the movable electrode 14 necessary for the current interruption is short and its movable members are light-weighted, high responsiveness is obtained in the opening operation, which can further shorten the current interruption time.

In particular, in this embodiment, since the electromagnetic repulsion operation part 41 is provided with the high-speed opening part 201 composed of the electromagnetic repulsion coil 44, the support part 57 fixing the electromagnetic repulsion coil 44, and the repulsion ring 45 provided to face the electromagnetic repulsion coil 44, the driving force of the electromagnetic repulsion operation part 41 which performs the opening operation rises very quickly owing to the electromagnetic repulsive force working between the excited electromagnetic repulsion coil 44 and the repulsion ring 45 and very high responsiveness can be obtained, as compared with an operation part whose driving source is a spring force or a hydraulic pressure.

Therefore, excellent SLF interruption performance is obtained for a steep transient recovery voltage.

Further, a thrust generating mechanism which gives the contact 10 of the gas contact part 9 a force (thrust) causing the electrodes to abut on each other is provided in the electromagnetic repulsion operation part 41.

Concretely, the thrust generating mechanism includes: the movable part 54 made of a magnetic material, which is indirectly connected to the first movable shaft 43 via the coupling 47, the collar presser 49, the collar 46, and so on; and the permanent magnet 51.

Consequently, the attraction force of the permanent magnet 51 works on the movable part 54, so that the spring presser 54*b* is pressed against a sidewall of the holding mechanism box 56, and in particular, the wiping springs 48 cause the movable part 54 and the first movable shaft 43 to constantly generate a predetermined thrust in the closing direction, and accordingly an engaged state (contact state) of the movable electrode 12 and the opposed electrode 18 can be maintained.

Other Embodiments (1) For example, in the first embodiment, in the process of the interruption, by the driving forces of the operation parts 29, 329, the movable electrode 14 separates from the fixed-side electrode 11 and at the same time the opposed electrode 18 and the movable electrode 12 separate from each other, but firstly, the timing at which the opposed electrode 18 and the movable electrode 12 separate may be later than the timing at which the movable electrode 14 separates from the fixed-side electrode 11.

For example, the flowing current may be interrupted by separating the movable electrode 14 from the fixed-side electrode 11 in the vacuum valve 8, and subsequently the insulation distance between the movable electrode 12 and the opposed electrode 18 may be ensured by separating the opposed electrode 18 and the movable electrode 12 in the gas contact part 9.

(2) In the second embodiment, the movable part 54 of the holding mechanism part 203 is indirectly connected to the movable shaft 43 of the high-speed opening part 201 via the wiping mechanism part 202, but the movable part 54 may be connected directly to the movable shaft 43.

(3) Further, as the operation parts, operation parts of another type may be used.

As an example, a linear electric motor may be provided in an operation part outside the vessel, and the linear operation part which performs the opening/closing operation by utilizing an interaction of its magnetic force may be used.

The linear operation part exhibits an intermediate property between that of an operation part whose driving source is a spring force or a hydraulic pressure and that of the electromagnetic repulsion operation part 41 of the second embodiment whose driving source is the electromagnetic repulsive force.

That is, it is slightly inferior in the rising of the driving force as compared with the electromagnetic repulsion operation part 41, but its driving force rises quickly enough as compared with the operation part whose driving source is the spring force or the hydraulic pressure.

Further, a magnet structure having larger magnetization energy as compared with the electromagnetic repulsion operation part 41 may be formed by doubly providing a plurality of permanent magnets to form an outer permanent magnet and an inner permanent magnet, the number of the magnets may be further increased, or the number of turns of the electromagnetic repulsion coil may be increased. In this case, it is possible to easily increase a volume of driving energy.

Therefore, the linear operation part of this embodiment is a suitable operation part when the contact part requires a relatively long stroke and high responsiveness.

The gas contact part 9 requires such performance, and therefore, by applying the linear operation part of this embodiment to the gas contact part 9, high responsiveness is obtained in the opening operation, which makes it possible to obtain a switch capable of further shortening the interruption time.

As a result, the contact 10 of the gas contact part 9 having high dielectric strength takes on most of a voltage applied to the switch, which can improve withstand voltage performance of the switch.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A switch comprising:

a hermetic vessel filled with an insulating medium;

an insulating spacer dividing the hermetic vessel into a first hermetic space and a second hermetic space;

a fixed electrode penetrating through and fixed to the insulating spacer;

a first conductor led into the first hermetic space;

a second conductor led into the second hermetic space;

a first movable electrode connected to the first conductor directly or via another member, the first movable electrode movably provided in a vacuum vessel disposed in the first hermetic space so as to abut on/separate from the fixed electrode;

a second movable electrode connected to the second conductor directly or via another member, the second movable electrode being provided in the second hermetic space so as to be movable in a first direction to become apart from the fixed electrode and in a second direction opposite the first direction;

an opposed electrode slidably provided in the fixed electrode to face the second movable electrode so as to separate from the second movable electrode in an open state and so as to be in contact with the second movable electrode in a closed state;

a first driver configured to generate a driving force for moving the first movable electrode so as to separate the first movable electrode from the fixed electrode when breaking a circuit between the first conductor and the second conductor from each other;

a second driver configured to generate a driving force and moves the second movable electrode in the first direction when performing an opening operation; and a driving force transmitting mechanism configured to move the opposed electrode in the second direction by converting a direction of the driving force for moving the second direction opposite the moving direction of the second movable electrode when the second driver generates the driving force for moving the second movable electrode in the first direction.

2. The switch according to claim 1, wherein the second driver includes:

a coil;

a coil fixing part fixing the coil to the hermetic vessel directly or via another member;

a magnetic body disposed on a side of the coil opposite the hermetic vessel to face the coil; and a first movable shaft fixed to the facing magnetic body so as to penetrate through the magnetic body and the coil; and wherein a control device is provided which transmits, as the driving force, a thrust of the first movable shaft generated by excitation of the coil to the driving force transmitting mechanism and separates the second movable electrode and the opposed electrode.

3. The switch according to claim 2, wherein the control device synchronizes generation timings of the driving forces of the first driver and the second driver.

4. The switch according to claim 2, wherein the second driver includes:

a mechanism box;

a second movable shaft held in the mechanism box so as to be coaxial with the first movable shaft and so as to be movable in an axial direction independently of the first movable shaft; and a holding mechanism part which, at a normal time, holds the second movable shaft at a first position at which the second movable shaft is a predetermined interval apart from the first movable shaft, and when the thrust in a direction toward the second movable shaft is applied to the first movable shaft, holds the second movable shaft at a second position to which the second movable shaft moves when the both movable shafts are in contact with each other.

5. The switch according to claim 4, wherein the second driver includes a first shock absorber which is disposed between the first movable shaft and the second movable shaft so as to provide the predetermined interval and absorbs a force generated when the moving first movable shaft collides with the second movable shaft directly or via another member.

6. The switch according to claim 5, wherein the second driver includes a second shock absorber which is fixed at the second position of the holding mechanism part and absorbs a force generated when the second movable shaft collides.

7. The switch according to claim 1, wherein the insulating medium is SF6 gas.

* * * * *